United States Patent [19]

Boultinghouse

[11] 3,964,284

[45] June 22, 1976

[54] METHOD OF EXPANDING COINS FOR DECORATIVE PURPOSES

[75] Inventor: George Boultinghouse, Bartlesville, Okla.

[73] Assignee: Harold D. Boultinghouse, Bartlesville, Okla. ; a part interest

[22] Filed: Nov. 21, 1974

[21] Appl. No.: 525,771

[52] U.S. Cl. ..... 72/54; 29/160.6; 29/423; 29/424; 72/378; 72/700

[51] Int. Cl.[2] ..... B21D 26/02

[58] Field of Search ..... 72/54, 363, 377, 378, 72/379, 700; 29/423, 424, 160.6

[56] References Cited

UNITED STATES PATENTS

| | | | |
|---|---|---|---|
| 2,960,763 | 11/1960 | Reichl | 29/423 |
| 3,742,745 | 7/1973 | Swenson, Sr. | 72/54 |

*Primary Examiner*—Carl E. Hall

*Attorney, Agent, or Firm*—Head, Johnson & Chafin

[57] ABSTRACT

A method of expanding the diametric size of coins and retaining the impressions, embossings, stamping definitions, or the like, thereon for use in jewelry, medallions, and the like, and which comprises initially placing a coin between two layers of carrier metal having a fluidity different from the fluidity of the metal of the coin whereby the carrier metal expands faster or flows more readily than the coin metal, applying pressure against the coin and carriers until the carrier material and coin metal begin to flow from the center out, removing the slightly enlarged or expanded coin from the initial carrier members and placing the enlarged coin between two additional layers of carrier material for repeating the process until the coin has been enlarged or expanded to the desired end size.

5 Claims, 4 Drawing Figures

METHOD OF EXPANDING COINS FOR DECORATIVE PURPOSES

BACKGROUND OF THE INVENTION

1. Field of the Invention

This invention relates to improvements in methods of making medallions, and the like, resembling coins, and more particularly, but not by way of limitation, to a method for expanding or enlarging a coin diametrically while retaining the impressions or embossings thereon to produce jewelry items, medallions, and the like.

2. Description of the Prior Art

For purposes of decoration, medallions, and the like, which resemble minted coins are very popular. For example, relatively large medallions resembling coins which are of a normal diametric size much smaller than the medallion have appeal for use as jewelry. However, at the present time it is usually necessary to make a blank of the approximate size as the desired medallion, and then emboss or stamp the faces of the blank to produce the desired coin-like effect. This is an expensive and time consuming procedure.

SUMMARY OF THE INVENTION

The present invention contemplates a novel method for producing medallions, and the like, for decorative purposes from actual coins by expanding or enlarging the diametric size of the coin while maintaining the embossing or impressions on the faces thereof substantially intact. The novel method comprises initially placing the desired coin, as for example a United States half dollar, between two layers of a carrier material having a different fluidity than from the fluidity of the material from which the coin is made whereby the carrier material will expand or flow more readily than the coin material, such a carrier material might be dead soft aluminum; applying pressure to the carrier and the coin in a direction substantially perpendicular to the plane of the coin until the carrier material begins to flow from the center out. This step will slightly increase the diameter of the coin, but the carrier members will hold the detail of the embossing on the faces of the coin, and carry or stretch them outwardly in direct proportion to the increased diametric size of the coin. The procedure is repeated with a second carrier for again slightly enlarging the diametric size of the coin and stretching the embossing proportionately. The process may be repeated as many times as necessary to produce the desired size for the coin-medallion. For example, in order to increase or expand the diametric size of a United States half dollar to approximately the diametric size of a United States silver dollar coin, it usually requires five of the expansion steps, whereas to increase the size of a United States penny to the approximate size of a United States nickel, it usually requires two of the expansion steps. The resultant coin very closely resembles the original coin, with the exception that the overall planar size thereof is increased.

DESCRIPTION OF THE PREFERRED EMBODIMENT

Figure 1:
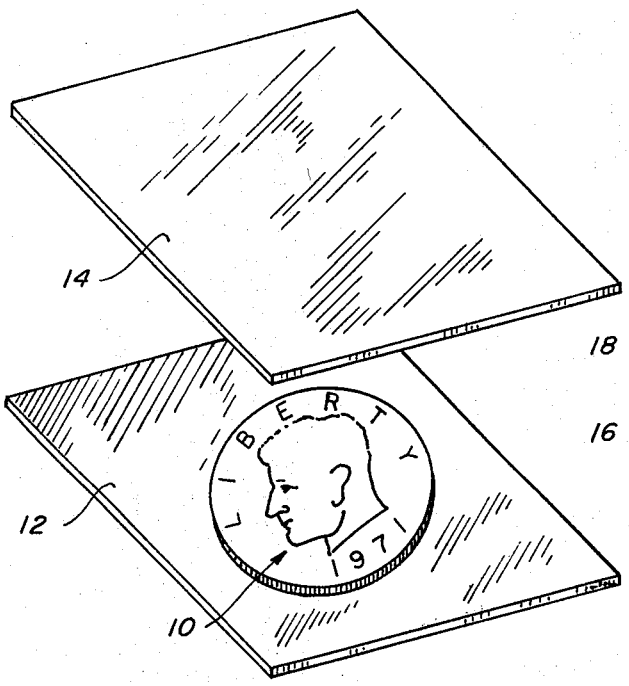
FIG. 1 is an exploded perspective view of a coin interposed between a pair of spaced carrier members prior to initiating the application of pressure.

Referring to the drawings in detail, reference character 10 generally indicates a coin, such as a United States half dollar, but not limited thereto, which is to be diametrically expanded or enlarged. The coin 10 is initially placed between a pair of substantially identical carrier members 12 and 14 which are preferably constructed from a relatively thin metallic material having fluidity different from the fluidity of the material from which the coin 10 is constructed whereby the carrier material will stretch, expand, or flow faster or more readily than the coin material. Dead soft aluminum has been found to produce excellent results when used for the carrier members 12 and 14. It may be desirable to utilize a multiple number of thin sheets of the carrier material laminated together in any suitable manner to provide a carrier of the desired thickness.

Figure 2:
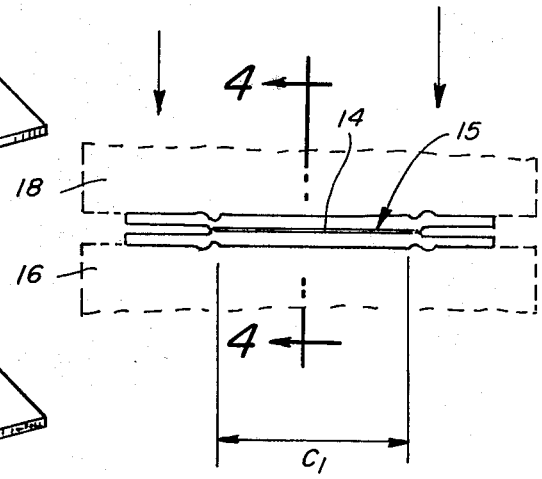
FIG. 2 is a side elevational view of a coin interposed between a pair of carrier members with the pressure device schematically depicted in broken lines.

The carriers 12 and 14 with the coin 10 interposed therebetween to provide a sandwich assembly as shown at 15 are then placed in a suitable press which preferably includes a stationary base element as shown in broken lines at 16 and a movable or reciprocal ram member as shown in broken lines at 18. At this time the diameter of the coin 10 is the original size of the coin. The coin-carrier assembly 15 is disposed on the base member 16 and the ram 18 is moved downwardly thereagainst in any well known manner for exerting pressure in a direction substantially perpendicular to the plane of the coin 10. This force or pressure is maintained on the assembly 15 until the carrier material begins to flow radially outwardly, or from the center out. During the application of pressure, the coin 10 and carriers 12 and 14 are stretched radially substantially equally in all directions, and the diameter of the coin 10 is increased to $C_1$ as indicated in FIG. 2. During this stretching procedure, the carrier metal carries the stamping definitions on the faces of the coin 10, increasing the impressions in proportion to the increasing of the diametric size of the coin 10. However, as soon as the carrier metal begins to flow independently of the coin, the efficient expanding of the coin stops. Accordingly, the application of pressure against the assembly 15 is ceased, and the slightly enlarged coin is removed from the initial or first carrier members 12 and 14.

Figure 3:
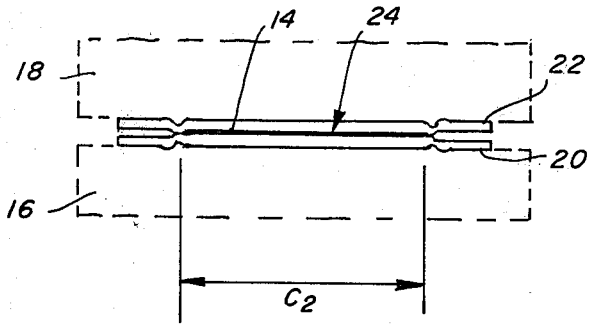
FIG. 3 is a view similar to FIG. 2 depicting the coin and carrier members subsequent to the application of sufficient pressure for increasing the diametric size of the coin.

The slightly enlarged coin may then be interposed between a second pair of carrier members 20 and 22, forming a second sandwich-like assembly 24. The second carrier members 20 and 22 are preferably identical to the carriers 14 and 16, and the assembly 24 is similarly placed on the base 16, and the ram 18 is actuated in the usual or well known manner for applying a force against the assembly 24 in a direction perpendicular to the plane of the slightly enlarged coin. Again, during the application of pressure, the carriers 20 and 22 and the coin are simultaneously stretched radially, with the carriers stretching the stamping definitions proportionally with the diametric stretching of the coin. The diameter of the coin is increased as indicated at $C_2$ in FIG. 3. Again, as soon as the carrier material begins to flow outwardly independently of the coin, the efficient coin stretching operation ceases, and accordingly, the pressure against the assembly 24 is stopped, and the enlarged coin is removed from the second carriers 20 and 22.

Of course, the process may be repeated with additional carrier members until the coin 10 has been expanded or enlarged to the desired diametric size.

Figure 4:
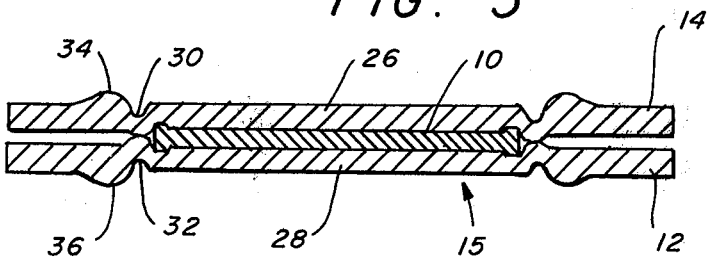
FIG. 4 is an enlarged sectional view taken on line 4—4 of FIG. 2.

Referring particularly to FIG. 4, it is considered that the application of force or pressure in a direction substantially perpendicular to the plane of the coin 10 causes the material of the carrier members to deform and fill in all the cavities in each face of the coin. As this occurs, the carrier material becomes thinner in cross section in the coin engaging areas 26 and 28 thereof. The carrier members tend to "pinch" together around the outer periphery of the coin as shown at 30 and 32. The carrier material also tends to "bunch up" or accumulate around the outer periphery of the pinching areas 30 and 32 as shown at 34 and 36. Apparently, the pressure of the ram 18, or the like, acting against the assembly 15 or the assembly 24 tends to thin and stretch the material of the carriers 12 and 14 at the sections 26 and 28 thereof whereby the carrier material moves radially outwardly, and since the material fills the cavities of the coin, the coin and stampings thereon are moved radially outwardly simultaneously with the carrier material. However, when the force or pressure of the ram 18 begins to result in the outward movement of the projections or bunches 34 and 36, it appears that the stretching of the coin ceases, and the material of the outer portions of the carriers begins to flow independently of the coin. It is at this time that the application of pressure is stopped, and the enlarging operation may be repeated with new carrier members.

The ultimate coin removed from the final step in the process is substantially identical in appearance with the initial coin prior to the expanding thereof, with the exception that the outer circumference or diameter of the end product is larger than the original coin. The result is very pleasing when used in jewelry, for medallions, or the like.

From the foregoing it will be apparent that the present invention provides a novel method for expanding coins and retaining the stamping definitions thereof in proportion to the enlarged coin size to produce attractive elements for use as medallions, in jewelry, and the like. The novel method comprises placing a coin between a pair of carrier elements and applying pressure against the assembly in a direction substantially perpendicular to the plane of the coin whereby the carrier material stretches the coin radially and simultaneously carries the stamping definitions or embossing on the faces of the coin for maintaining the size of the embossing proportional with the enlarged size of the coin. The novel method is simple, efficient and economical.

Whereas the present invention has been described in particular relation to the drawings attached hereto, it should be understood that other and further modifications, apart from those shown or suggested herein, may be made within the spirit and scope of this invention.

What is claimed is:

1. A method of expanding coins having stamping definitions thereon to a larger diametric size than the original size thereof and retaining the stamping definitions thereon which comprises placing the original coin in a carrier means of a larger planar dimension than the coin, applying pressure against the carrier means and coin in a direction substantially perpendicular to the plane of the coin whereby the carrier means and coin flow whereby the coin stretches radially outwardly, and stopping the application of pressure when the carrier means begins to flow outwardly independently of the coin.

2. A method as set forth in claim 1 and including the steps of removing the radially stretched coin from the carrier means subsequent to the cessation of the application of pressure, placing the radially stretched coin in a second carrier means, and applying pressure against the second carrier means and the radially stretched coin in a direction substantially perpendicular to the plane of the coin, and stopping the application of pressure when the second carrier means begins to flow outwardly independently of the coin.

3. A method as set forth in claim 2 wherein the process is repeated as required for stretching the coin to the desired diametric size.

4. A method as set forth in claim 1 wherein the step of placing the original coin in a carrier means includes placing the original coin between two layers of a carrier material which has a fluidity different from the fluidity of the material of the coin whereby the carrier material will stretch more readily than the coin material.

5. A method as set forth in claim 1 wherein the step of stretching the coin radially outwardly includes increasing any stamping definitions on the faces of the coin proportional to the radial stretching of the coin.

* * * * *